US006076447A

United States Patent [19]

Damask

[11] Patent Number: 6,076,447

[45] Date of Patent: Jun. 20, 2000

[54] HAND OPERATED PUNCHING DEVICE

[76] Inventor: Douglas M. Damask, 6925 Ashwood Rd., Apartment 304, Woodbury, Minn. 55125

[21] Appl. No.: 09/128,153

[22] Filed: Aug. 3, 1998

Related U.S. Application Data

[63] Continuation of application No. 08/772,815, Dec. 24, 1996, abandoned.

[51] Int. Cl.[7] ..... B26F 1/14

[52] U.S. Cl. ..... 83/618; 83/167; 83/467.1; 83/588; 83/628; 83/633; 83/687

[58] Field of Search ..... 83/687, 590, 602, 83/618, 620, 628, 467.1, 468.2, 468.7, 167, 633, 588, 605, 522.19

[56] References Cited

U.S. PATENT DOCUMENTS

| | | | |
|---|---|---|---|
| 374,880 | 12/1887 | Rosback . | |
| 1,877,105 | 9/1932 | Wilkerson . | |
| 2,137,716 | 11/1938 | Faas | 164/91 |
| 2,149,268 | 3/1939 | Brennan | 164/91 |
| 3,224,314 | 12/1965 | Wolnez | 83/522 |
| 3,269,246 | 8/1966 | Hänggi | 83/588 |
| 3,408,889 | 11/1968 | Murphy | 83/599 |
| 3,678,792 | 7/1972 | Dvorak | 83/459 |
| 3,741,055 | 6/1973 | Sarkisov et al. | 83/132 |
| 4,499,805 | 2/1985 | Mori | 83/468 |
| 4,716,948 | 1/1988 | Brissette | 150/132 |
| 4,879,932 | 11/1989 | Scalise et al. | 83/30 |
| 4,893,535 | 1/1990 | Bentrim et al. | 83/133 |
| 4,941,381 | 7/1990 | Garner | 83/468.94 |
| 5,067,242 | 11/1991 | Singer | 30/364 |
| 5,117,719 | 6/1992 | Takagi et al. | 83/640 |
| 5,186,037 | 2/1993 | Bihler | 72/442 |
| 5,495,671 | 3/1996 | Shun-Yi | 30/364 |
| 5,611,254 | 3/1997 | Rall | 83/467.1 |

FOREIGN PATENT DOCUMENTS

| | | | |
|---|---|---|---|
| 174556 | 9/1952 | Germany | 83/602 |
| 1577688 | 9/1969 | Germany . | |
| 162535 | 9/1933 | Switzerland | 83/633 |
| 893212 | 4/1962 | United Kingdom | 83/633 |

*Primary Examiner*—Rinaldi I. Rada
*Assistant Examiner*—Charles Goodman
*Attorney, Agent, or Firm*—Westman, Champlin & Kelly, P.A.; S. Koehler

[57] ABSTRACT

A punching device for punching an aperture in a sheet includes a housing and a handle pivotally joined to the housing with a first pivot connection. A drive plate is slidably displaceable in the housing. The drive plate includes a protrusion extending from a surface. The drive plate is preferably pivotally joined to the handle with a second pivot connection remote from the first pivot connection. A punch is disposed in the housing and operably engages the protrusion of the drive plate such that displacement of the drive plate in the housing causes operation of the punch.

10 Claims, 7 Drawing Sheets

HAND OPERATED PUNCHING DEVICE

This application is a continuation of application Ser. No. 08/772,815, filed Dec. 24, 1996, now abandoned.

BACKGROUND OF THE INVENTION

The present invention relates to a device for punching apertures in a sheet of material. More particularly, the present invention is a hand operated punching device for making apertures in a sheet of material suitable for holding a smaller sheet of material, such as a business card.

Business cards are used by many people to identify themselves and their company/organization that they are associated with. The business cards are small in form and can be easily carried and organized. It is quite common for a person to attach a business card to correspondence, reports, brochures or other documents. Typically, the business card is either stapled or clipped to the item. Stapled business cards are not easy to remove and the stapling process damages the business cards. "Paper-clipping" the business card to the document is also not a satisfactory solution since paper-clipping also damages the business card and the business card can be easily separated from the document.

In addition to stapling or paper-clipping business cards to documents, some devices have been advanced for forming spaced-apart parallel slits in the document. The slits are suitably sized to receive opposite corners of a business card. U.S. Pat. Nos. 4,893,435 and 4,879,932 disclose two such devices. In both of these devices, a pair of slitting blades extend downwardly from an upper platen and are sized, positioned and arranged to form the spaced-apart parallel slits. In U.S. Pat. No. 4,893,535, the upper platen moves generally normal to the sheet of paper wherein the operator exerts downward pressure upon an upper surface of the platen. In U.S. Pat. No. 4,879,932, the upper platen pivots on a pin forming a hinge with a lower base. The slitting blades pivot with respect to the pin when downward force is applied to the platen.

One disadvantage of the above-described devices is that neither device makes apertures in the document, but rather, only small slits. Insertion of the business cards into the slits is not particularly easy. The cutting devices are also only blades, which can dull easily with use. Therefore, there exists a need to provide a hand operated punching device that forms apertures in a sheet of paper suitable for holding a business card, the device being constructed to withstand repeated and continuous use.

SUMMARY OF THE INVENTION

A punching device for punching an aperture in a sheet includes a housing and a handle pivotally joined to the housing with a first pivot connection. A drive plate is slidably displaceable in the housing. The drive plate includes a protrusion extending from a surface. The drive plate is preferably pivotally joined to the handle with a second pivot connection remote from the first pivot connection. A punch is disposed in the housing and operably engages the protrusion of the drive plate such that displacement of the drive plate in the housing causes operation of the punch.

In a preferred embodiment, a plurality of punches are provided in the housing. Each punch operably engages a protrusion formed on the drive plate. Preferably, the protrusions comprise ramp structures such that displacement of the drive plate in a horizontal direction causes the punches to be displaced in a vertical direction.

DETAILED DESCRIPTION OF THE PREFERRED EMBODIMENTS

Figure 1:
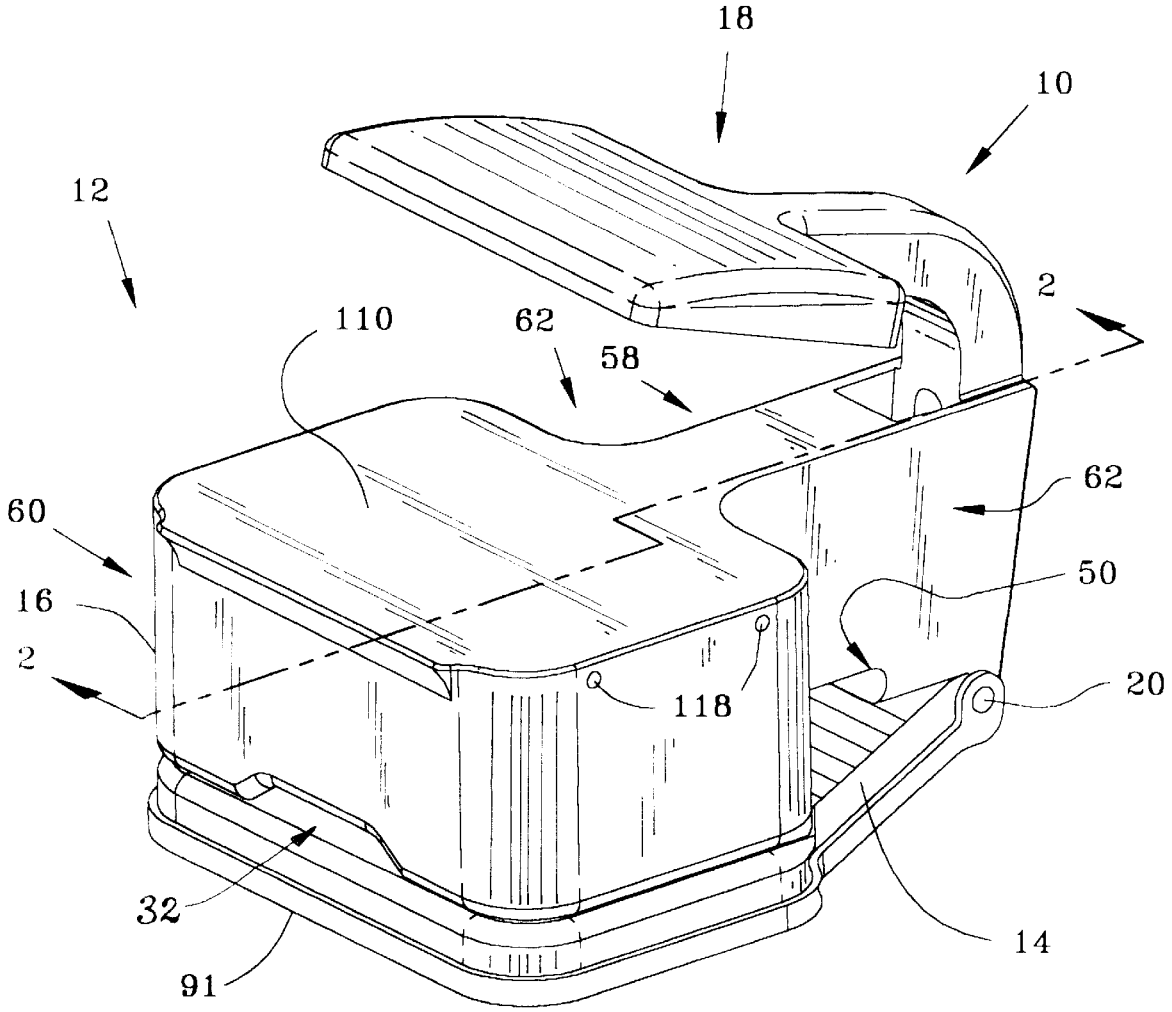
FIG. 1 is a perspective view of a punching device of the present invention.
Figure 2:
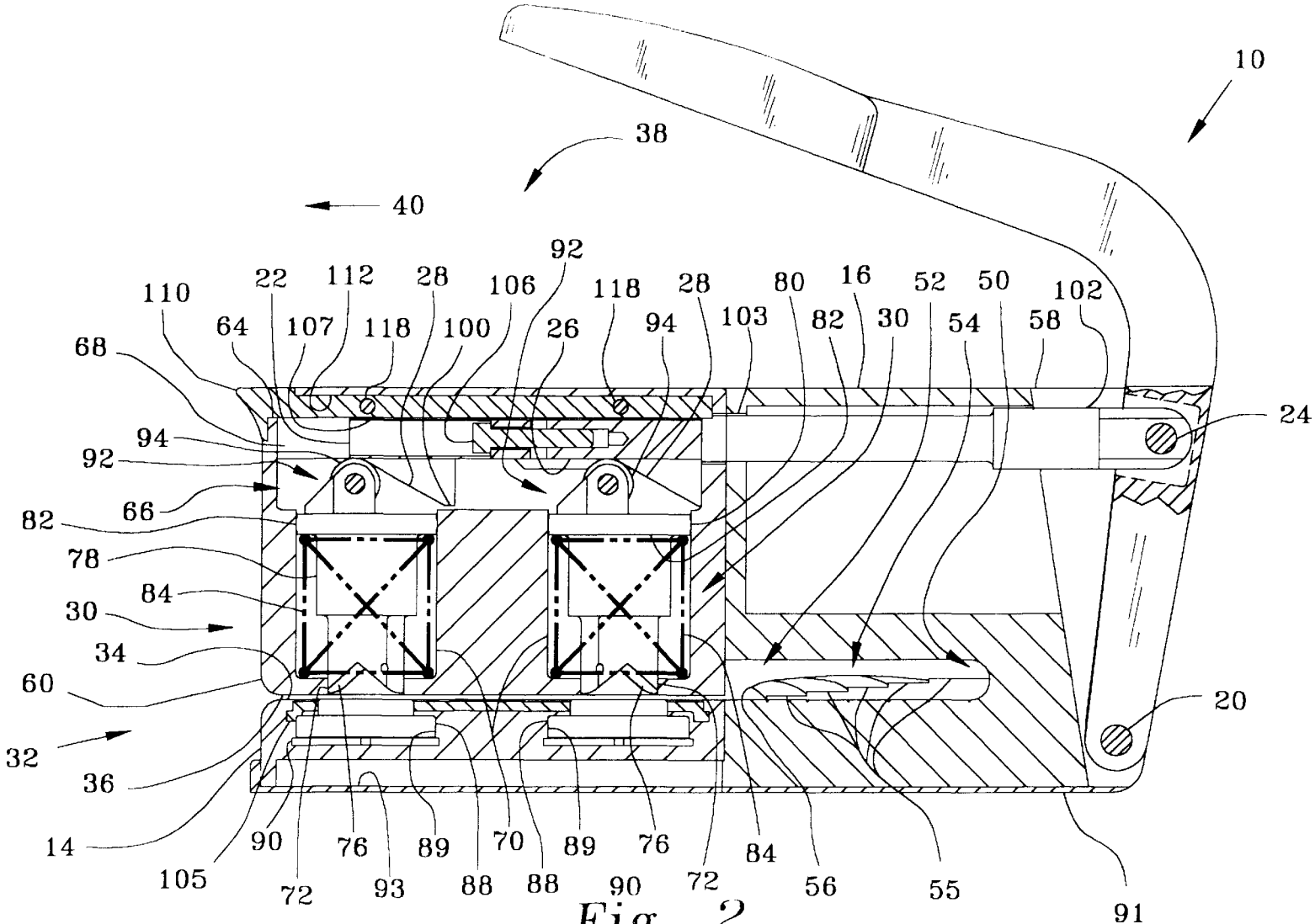
FIG. 2 is a sectional view of a punching device taken lines 2—2 of FIG. 1.
Figure 3:
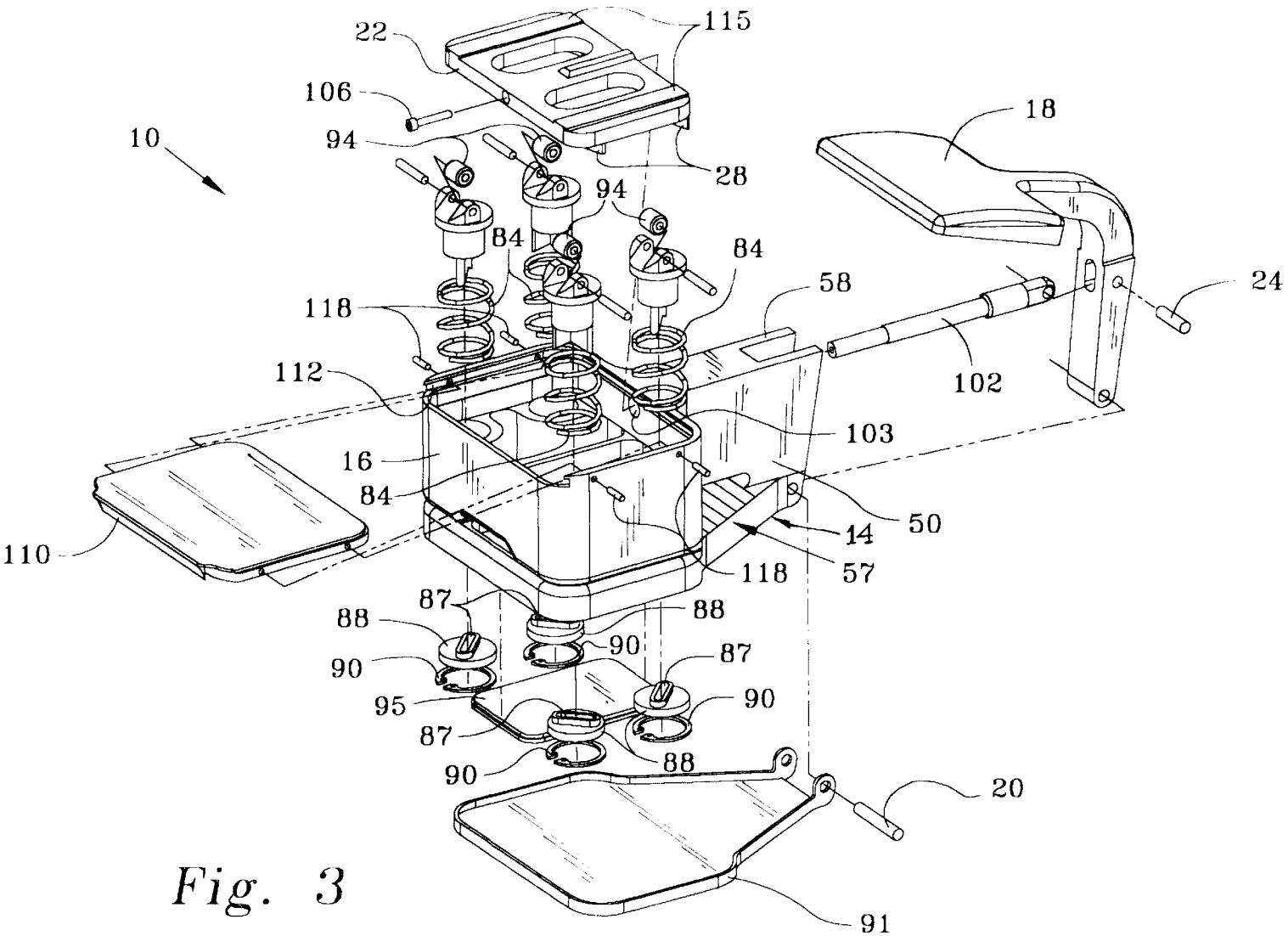
FIG. 3 is an exploded perspective view of the punching device.
Figure 4:
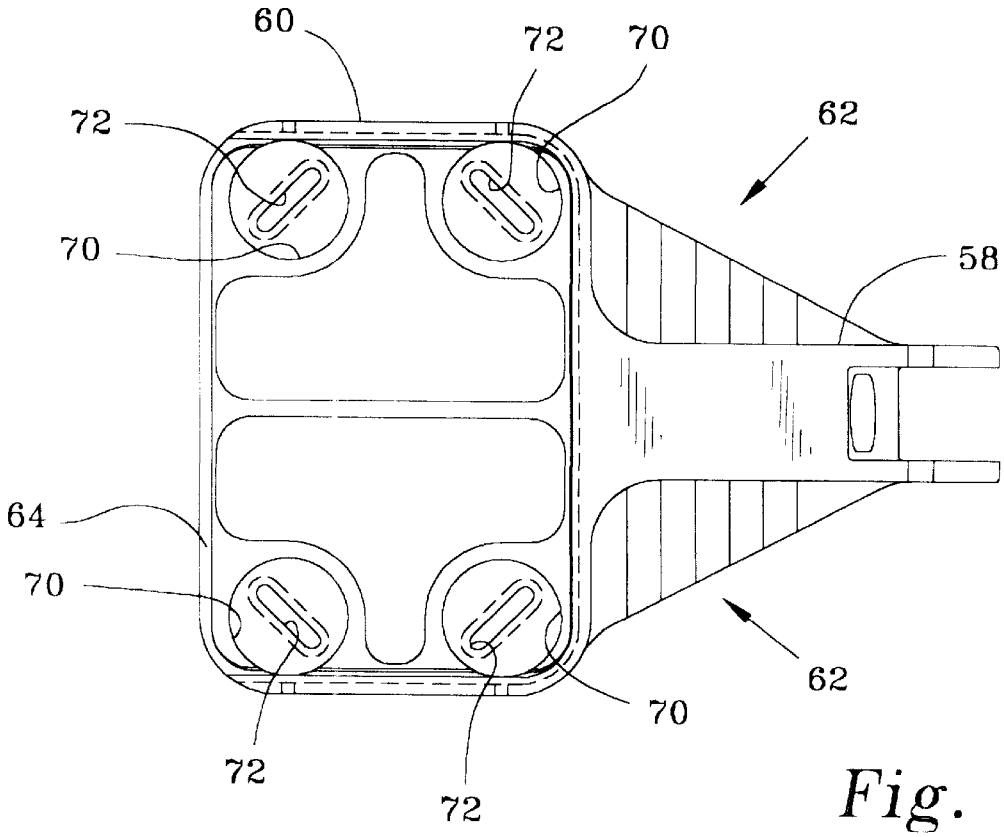
FIG. 4 is a top plan view of a housing of the punching device.

A punching device 10 of the present invention is illustrated in FIGS. 1, 2 and 3. In the embodiment illustrated, the punching device 10 includes a housing 12 having a base portion 14 and an upper portion 16. A handle generally indicated at 18 is pivotally attached to the housing 12 with a pivot pin 20. A drive plate 22 is preferably joined to the handle 18 with a pivot pin 24 that is spaced-apart from the pivot pin 20. A lower surface 26 of the drive plate 22 includes protrusions 28 that engage punches 30 disposed within the upper portion 16.

Figure 11:
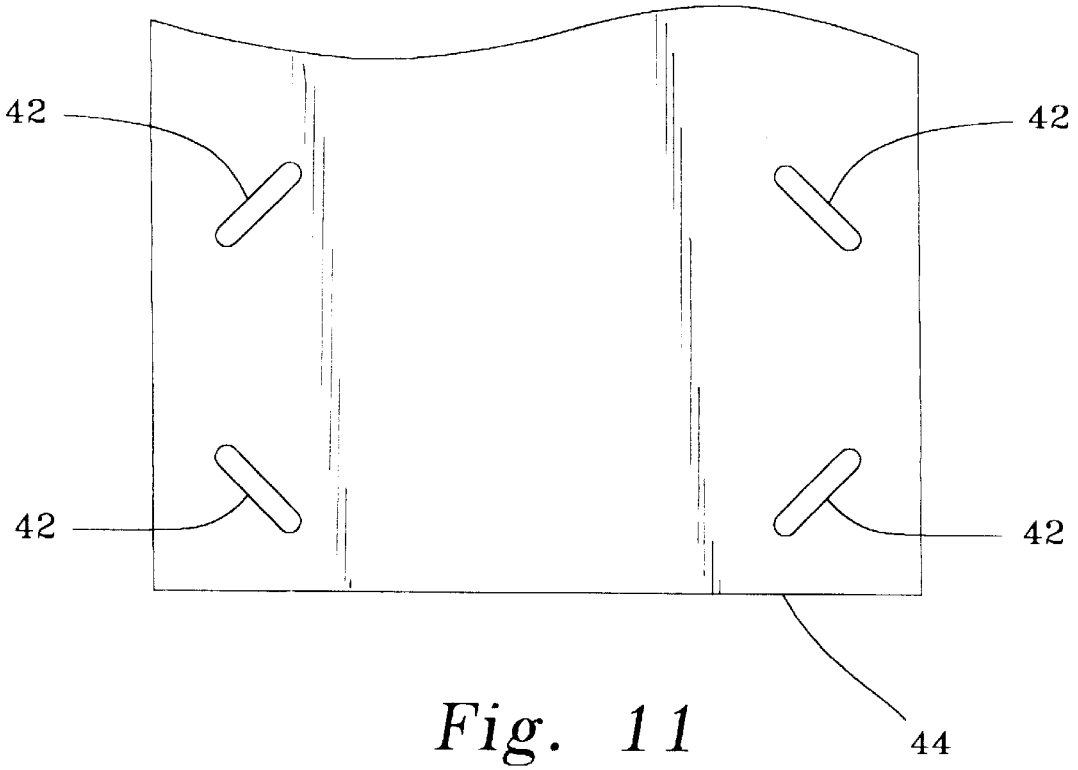
FIG. 11 is a portion of a sheet of material illustrating location of apertures made by the punching device of the present invention.
Figure 9:
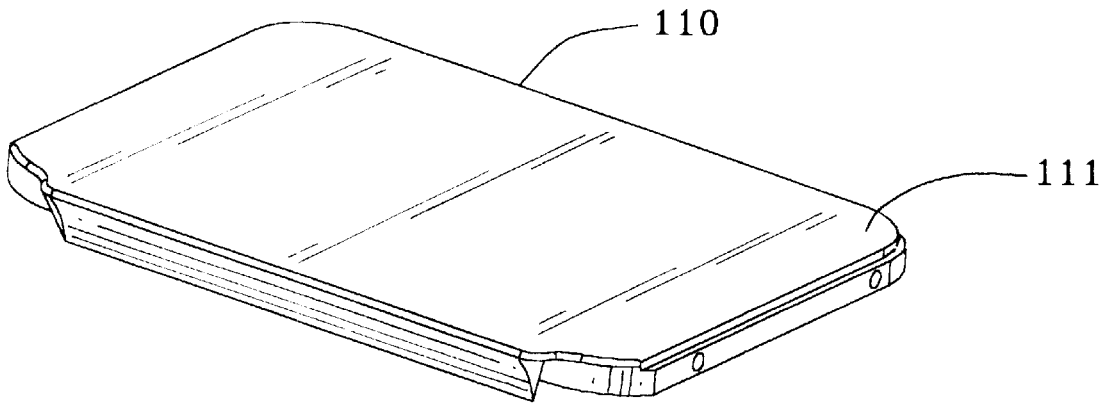
FIG. 9 is a perspective view of a cover primarily illustrating an upper surface thereof.
Figure 10:
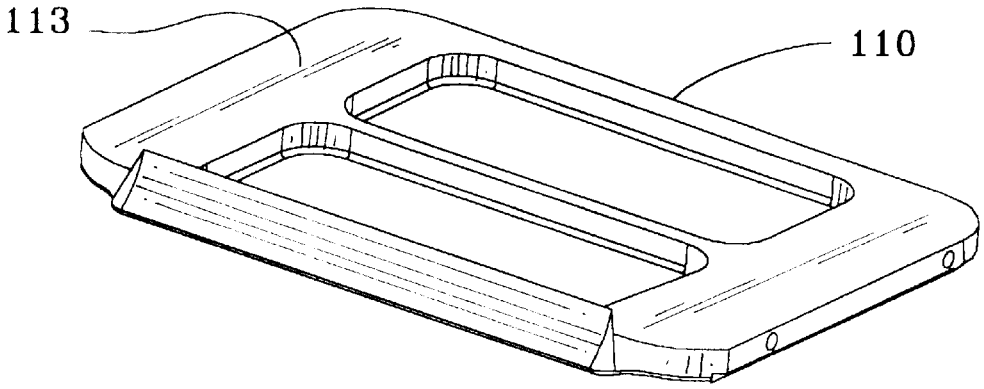
FIG. 10 is a perspective view of the cover primarily illustrating a lower surface thereof.

A sheet of material 44 (FIG. 11) to be punched is positioned within a slot 32 formed between an upper surface 34 of the base portion 14 and a lower surface 36 of the upper portion 16. When the handle 18 is pushed downwardly in a direction indicated by arrow 38 toward the upper portion 16, the handle 18 urges the drive plate 22 in a direction indicated by arrow 40, which in turn, urges the punches 30 toward the base portion 14 to punch one or more apertures 42 in the sheet of material 44 as illustrated in FIG. 11. Unlike prior art devices previously advanced, the punching device 10 of the present invention provides apertures 42 rather than slits, which allow easy insertion of a smaller card, such as a business card, not shown, into the apertures 42.

Referring now to individual components of the punching device 10, the housing 12 is preferably formed from a single unitary piece wherein the base portion 14 is integrally attached to the upper portion 16. In the embodiment illustrated, a connecting portion 50 proximate the pivot pin 20, joins the base portion 14 to the upper portion 16. If desired, the base portion 14 can be manufactured separate from the upper portion 16 and attached thereto with suitable fasteners and/or welds, adhesives or the like. The slot 32 for accepting the material 44 to be punched is relatively narrow between the surfaces 34 and 36 to limit the thickness of the material which will be punched. The slot 32 opens to a wider portion indicated at 52. The wider portion 52 allows the sheet of material 44 to be easily grasped and pulled in order to align the sheet of material 44 with the punches 30 at the desired location.

In a preferred embodiment, the upper surface 34 includes a step assembly 54 comprising steps 55 of increasing height from the punches 30 and toward the connecting portion 50. The step assembly 54 provides forward facing surfaces 56 that an operator can use to control the location of apertures 42 to be punched in the sheet of material 44 from an edge of the material 44 contacting the forward facing surfaces 56. In FIG. 2, the heights of the individual steps 55 of the step assembly 54 have been exaggerated in order to enhance understanding. The height of each of the individual forward facing surfaces 56, for example, can be 0.010 of an inch.

In an alternative embodiment illustrated in FIG. 3, lines 57, such as by engraving, can be provided on the upper surface 34. The lines 57 function as reference markers to be used by the operator for locating the apertures 42 as desired in the sheet of material.

The upper portion 16 includes a support portion 58 extending from the connecting portion 50 and a wider container portion 60. Preferably, the support portion 58 is narrower than the container portion 60 to provide an open area 62 behind the container portion 60 such that the sheet of material 44 can be easily grasped after insertion in the slot 32. In the embodiment illustrated, the container portion 60 includes an upwardly facing opening 64 of a void 66 formed in the container 60. The void 66 includes an enlarged recess 68 and individual bores 70 for the punches 30. Each bore 70 opens to the slot 32 with an opening 72 smaller than the corresponding bore 70.

Figure 5:
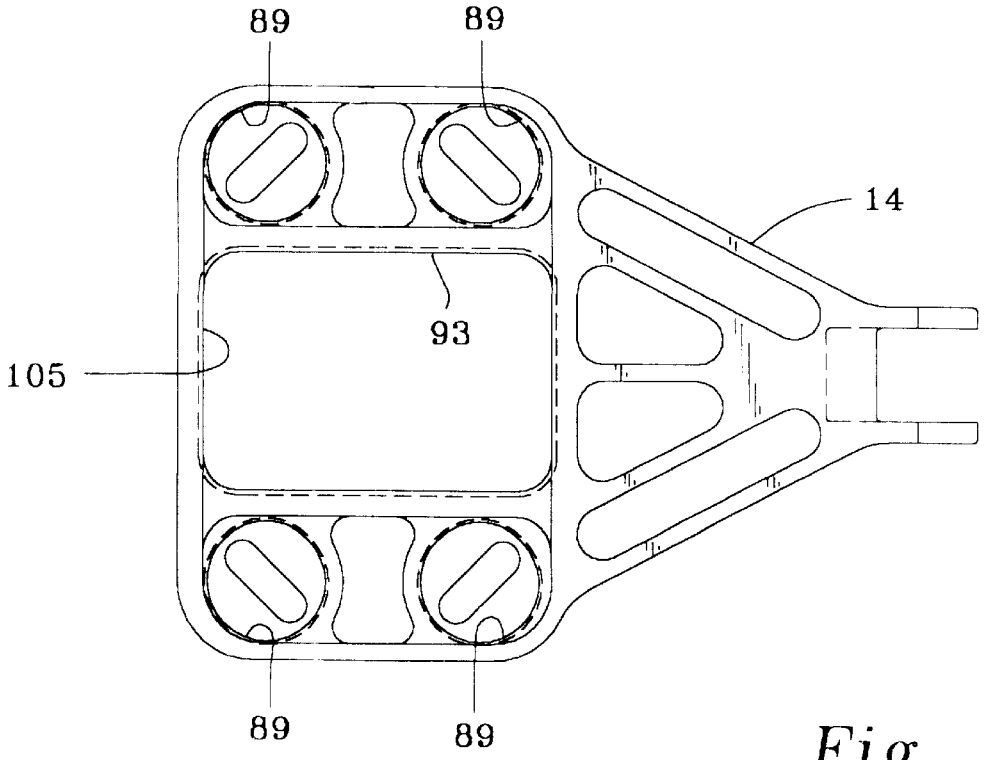
FIG. 5 is a bottom plan view of the housing.
Figure 8:
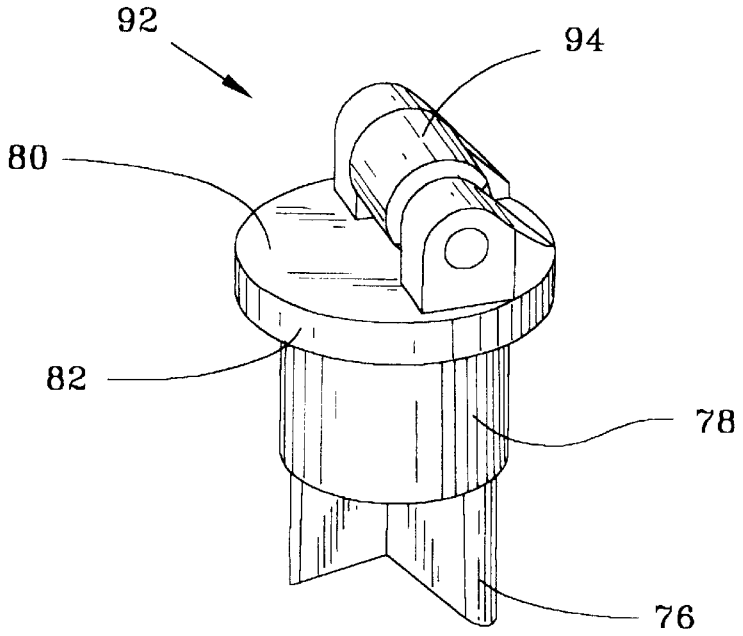
FIG. 8 is a perspective view of a punch having a roller assembly.

Referring also to FIG. 8, each punch 30 includes a cutting head 76 that preferably extends into the opening 72 in a retracted position so as to maintain the alignment of the punch 30 with the opening 72. A shaft portion 78 couples the cutting head 76 to an enlarged cap member 80. The cap member 80 forms an annular flange 82. As illustrated in FIGS. 2 and 3, a spring 84 is disposed in each of the bores 70 to engage a lower surface thereof and also engage the annular flange 82 of each corresponding punch 30. Springs 84 individually retract the punches 30 after displacement downwardly towards the base portion 14. Preferably, the cutting heads 76 are received by apertures 87 in dies 88 disposed in the base portion 16. The dies 88 are located in suitable recesses 89 and held therein by suitable fasteners such as snap rings 90. Referring also back to FIG. 1, a cover 91 removably attaches to the base portion 14 to form a recess 93 to collect punched material. A cover plate 95 attaches to the base portion 14 and covers an aperture 105 (FIG. 5) convenient for manufacture by casting.

Figure 6:
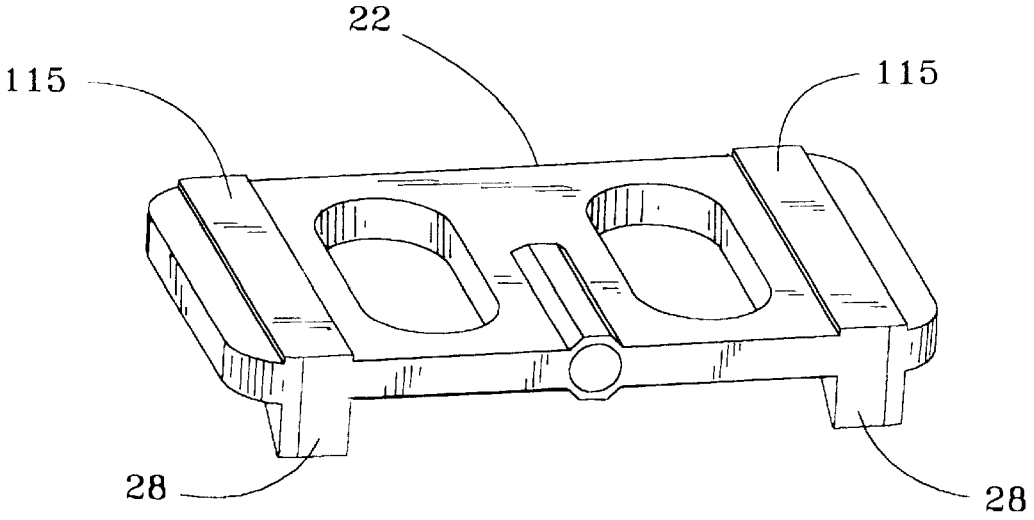
FIG. 6 is a perspective view of a drive plate an upper surface thereof.
Figure 7:
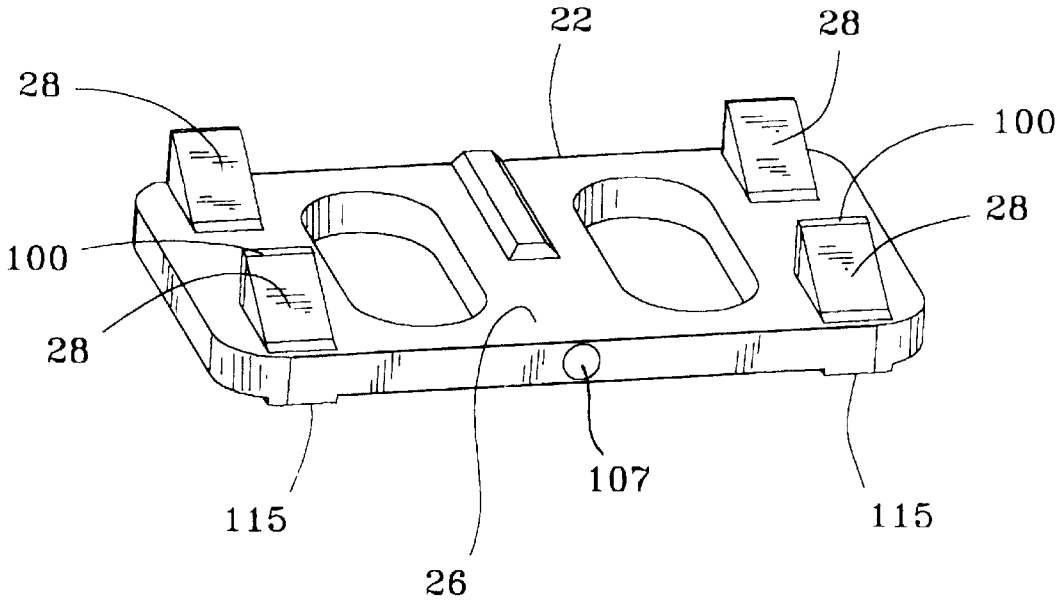
FIG. 7 is a perspective view of the drive primarily a lower surface thereof.

As described above, the punches 30 are displaced toward the base portion 14 by the drive plate 22. Referring to FIG. 2, 6 and 7, an upper portion 92 of each of the punches 30 engages one of the protrusions 28 formed on the lower surface 26 of the drive plate 22. In a preferred embodiment, the upper portions 92 comprise rollers 94 that engage the protrusions 28. The rollers 94 reduce friction between the punches 30 and the protrusions 28. If desired, the upper portions 92 can be a rigid solid element that engages the protrusions 28.

In the embodiment illustrated, the protrusions 28 comprise ramp structures. The ramp structures 28 are particularly useful because as the springs 84 expand to return the punches 30 to the retracted position, the drive plate 22 is urged in a direction opposition to arrow 40 to return the handle 18 to its upright position. In a further embodiment, some of the ramp structures 28, for example, two out of four, include flat portions 100. The flat portions 100 reduce the force trying to return the handle 18 to its upright position. Specifically, as the drive plate 22 is displaced in the direction of arrow 40, some of the rollers 94 would reach and engage the flat portion 100 while the remaining rollers 94 would still engage the inclined portion of the ramp structures 28. Since only those rollers 94 that are engaging the inclined portions of the ramp structures 28 contribute to the net force tending to return the handle 18 to its upright position, the amount of force at the end of stroke of displacement of the drive plate 22 to hold the punches 30 down is reduced.

The drive plate 22 is coupled to the handle 18 through a drive shaft 102. The drive shaft 102 extends from the handle 18 through a bore 103 formed in the rigid support portion 58 that opens to the recess 68. The drive plate 22 is attached to an end of the drive shaft 102 with a fastener 106 located in a recess 107 of the drive plate 22.

A cover plate 110 illustrated in FIGS. 2, 3, 9 and 10 closes the opening 64. The cover plate 110 slides onto the container portion 60 wherein perimeter portions of an upper surface 111 of the cover plate 110 engages a perimeter flange 112. Suitable fasteners 118 retain the cover plate 110 in position. The drive plate 22 slides upon a lower surface 113 of the cover plate 110. Preferably, spaced-apart, machined surfaces 115 are provided on the drive plate 22 (FIGS. 6 and 7) to engage the cover plate 110 in order to provide smooth operation.

Removal of the cover plate 110 and the drive plate 22 from the drive shaft 102 allows access to the punches 30. By merely removing selected punches 30 from the bores 70, the operator can configure the punching device 10 to punch a selected number of apertures 42 having a selected arrangement.

Although the present invention has been described with reference to preferred embodiments, workers skilled in the art will recognize that changes may be made in form and detail without departing from the spirit and scope of the invention.

What is claimed is:

1. A hand operated punching device for punching apertures in a sheet, the hand operated punching device comprising:

a housing having a base forming a gap for receiving a sheet therein;

a drive plate slidably displaceable in the housing in a plane parallel to the base, the drive plate having protrusions extending from a surface, wherein the drive plate protrusions are spaced apart in two dimensions, a first spacing between protrusions along the direction of the drive plate displacement and a second spacing perpendicular to the first spacing and in a plane parallel to the base;

a plurality of punch assemblies disposed in the housing, each punch assembly comprising a punch disposed in a recess of the housing and operably engaging one of the protrusions of the drive plate such that displacement of the drive plate in the housing causes displacement of the punch toward the base and into the gap; and a handle operating the punch assemblies through actuation of the drive plate, the handle having a first end pivotally joined to the housing and operatively joined to the drive plate to selectively displace the drive plate with pivotal displacement of the handle.

2. The punching device of claim 1 wherein each punch assembly includes a spring for retracting the punch back into the housing.

3. The punching device of claim 2 wherein the drive plate slides over the recesses of the punches.

4. The punching device of claim 3 and further comprising a drive shaft joining the handle to the drive plate.

5. The punching device of claim 4 wherein the drive shaft is removable from the drive plate.

6. The punching device of claim 5 wherein the drive plate includes selected bearing surfaces for slidably engaging the housing.

7. The punching device of claim 6 wherein each punch assembly includes a roller for engaging one of the protrusions of the drive plate.

8. The punching device of claim 1 wherein the housing includes a step assembly in the gap, the step assembly having a plurality of surfaces spaced-apart and facing a lower surface of the housing, the plurality of surfaces being of increasing height.

9. The punching device of claim 1 wherein the drive plate is pivotally joined to the handle.

10. The punching device of claim 1 wherein the drive plate is pivotally joined to the handle with a second pivot connection remote from the first-mentioned pivot connection.

* * * * *